United States Patent [19]

Dürkop

[11] Patent Number: 4,472,011

[45] Date of Patent: Sep. 18, 1984

[54] ELECTRICAL CLAMP

[75] Inventor: Willi Dürkop, Detmold, Fed. Rep. of Germany

[73] Assignee: C.A. Weidmüller GmbH & Co., Detmold, Fed. Rep. of Germany

[21] Appl. No.: 445,268

[22] Filed: Nov. 29, 1982

[30] Foreign Application Priority Data

Nov. 26, 1981 [DE] Fed. Rep. of Germany ..... 3146914

[51] Int. Cl.[3] ..... H01R 9/00

[52] U.S. Cl. ..... 339/34; 339/198 R; 339/198 GA; 339/263 R

[58] Field of Search ..... 339/34, 198 R, 198 GA, 339/248 R, 249 A, 263 R

[56] References Cited

FOREIGN PATENT DOCUMENTS 57778 1/1975 Australia ..... 339/198 GA 2342988 3/1975 Fed. Rep. of Germany ..... 339/198 GA

*Primary Examiner*—John McQuade

*Assistant Examiner*—Gary F. Paumen

*Attorney, Agent, or Firm*—Peter K. Kontler

[57] ABSTRACT

A clamp with a housing, a contact rail and a slide having clamping jaws flanking the contact rail and an interconnecting fastener, for effecting electrical connections between spaced-apart conductors, has a guide member interposed between the housing and slide. The guide member is mounted to one of the clamping jaws and has an elongated surface in slidable engagement with a surface of the housing, a leg contacting the clamping jaws for force transmission and prevention of relative rotation of the clamping jaws, a shoulder contacting said one clamping jaw also for force transmission, a recess for receiving said one clamping jaw defined by the leg and shoulder, and releasable locking engagement means for securing the slide in a neutral position independent of the action of the fastener.

14 Claims, 3 Drawing Figures

ELECTRICAL CLAMP

BACKGROUND OF THE INVENTION

The present invention relates to devices for establishing plural connections between spaced-apart electrical conductors, e.g., between one or more bus bars in the recess of a terminal box and one or more strip-shaped conductors.

It is already known to provide an elongated conductor with several discrete clamping devices, each of which can selectively establish and/or break connection between such conductor and one or more bus bars. In conventional clamps, a slide is provided which has two clamping jaws and a screw extending therebetween. The slide is mounted on the contact rail of the clamp, with the clamping jaws positioned on opposing sides of the contact rail, and the slide can be shifted into and out of contact with a bus bar, which carries the power supply. If power supply is to pass from the bus bar via the clamp to the contact rail, the slide is moved into contact with the bus bar and "closed" by turning the screw so that the clamping jaws engage the contact rail and the bus bar and establish a connection therebetween. If the power supply to the clamp (and the units and devices connected to it) is to be interrupted, the clamping jaws of the slide are loosened by means of turning the screw and the thus "open" slide is shifted back out of contact with the bus bar, back into the housing of the clamp.

Attempts have been made to improve the ability to shift the open slide on the contact rail, e.g., by providing a plastic sleeve surrounding the clamping screw and mounting the sleeve on a ledge of the housing. However, this construction repeatedly results in tilting of the clamping jaws in various directions when shifting the open slide on the contact rail. This is because the clamping jaws in such construction still have a considerable degree of unrestrained movement when the slide is in an open position, i.e., the clamping jaws lie relatively loosely in the housing surrounding them. Moreover, the force necessary to move the open slide must be applied with the screwdriver which is used to turn the clamping screw, and because of the distance of the gripping location from the contact rail, the application of such force is difficult and further tends to cause tilting of the clamping jaws.

An additional disadvantage of prior art clamps has been their exclusive reliance upon the clamping screw to insure that unwanted connection between the contact rail and bus bar is avoided. If, when the slide is moved out of contact with the bus bar, i.e., back into the housing, the clamping screw is inadvertently not securely tightened, the slide may, upon jostling of the clamp, particularly when the clamp is mounted over the bus bar and the slide moves in an up and down direction, move into contact with the bus bar and charge the contact rail and associated unit or device. This can damage the unit or device and may even result in injury to the operator, repairer or installer A still further disadvantage of prior art clamps has been that, particularly when the clamping jaws are hollow, the clamping jaws have a tendency to rotate about the axis of the clamping screw as the screw is turned to tighten the slide.

OBJECTS AND SUMMARY OF THE INVENTION

An object of the present invention, therefore, is to provide a clamp with a simple, compact and versatile guide for the slide for effecting easy, secure shifting of the open slide to the bus bar and back.

Another object of the invention is to provide a clamp of the above outlined character in which the guide, in a novel and improved manner, prevents tilting of the clamping jaws during movement of the open slide.

An additional object of the invention is to provide a clamp of the above outlined character in which the guide, in a novel and improved manner, facilitates application of necessary force and transmission of such force to the clamping jaws for shifting the open slide out of contact with the bus bar.

Still another object of the invention is to provide a clamp of the above outlined character in which the guide, in a novel and improved manner, facilitates application of necessary force and transmission of such force to the clamping jaws for shifting the open slide into contact with the bus bar.

A further object of the invention is to provide a clamp of the above outlined character in which the guide includes means independent of the clamping screw for securely retaining the slide in the open position.

An additional object of the invention is to provide a clamp of the above outlined character in which the guide, in a novel and improved manner, prevents relative rotation of the clamping jaws even if the fastener connecting them is a screw.

The invention resides in the provision of a clamp for establishing a connection between several spaced-apart conductors (for example, bus bars or strip-shaped conductors). The improved clamp comprises a housing composed of insulating material surrounding a portion of a first conductor, a slide mounted on the first conductor and guide means for the slide.

The slide can move along the first conductor into and out of contact with a second conductor to establish and break an electrical connection therebetween. The slide has first and second clamping jaws disposed on opposite sides of the first conductor and a fastener extending therebetween.

The guide means can constitute a simple, one-piece plastic construction having a surface slidably engageable with the housing for preventing tilting of the clamping jaws; a shoulder and a first leg for engaging portions of the clamping jaws for facilitating transmission of force from the guide to the clamping jaws; a projection on the first leg for preventing relative rotation of the clamping jaws; and a second leg including means for releasably engaging the housing to retain the slide in an open position out of contact with the second conductor. The engaging means can constitute a detent engageable with a mating detent on the housing.

The novel features which are considered as characteristic of the invention are set forth in particular in the appended claims. The improved device itself, however, both as to its construction and the mode of installing the same, together with additional features and advantages thereof, will be best understood upon perusal of the following detailed description of certain specific embodiments with reference to the accompanying drawing.

DESCRIPTION OF THE PREFERRED EMBODIMENT

Figure 1:
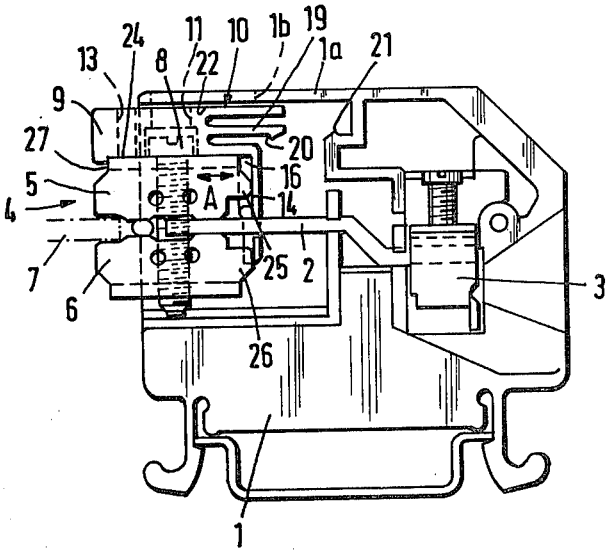
FIG. 1 is a side elevational view of a clamp which embodies one form of the invention.

The clamp which is shown in FIG. 1 comprises a housing 1, composed of insulating material, a contact rail 2 having on its one end a connection 3 for a conductor and a slide 4 mounted on the contact rail 2 for movement in the direction of arrow A in FIG. 1. The slide 4 has two jaws flanking the contact rail 2; shown in FIG. 1 as an upper clamping jaw 5, located above the contact rail 2, and a lower clamping jaw 6, located below the contact rail 2. A clamping screw 8 is provided to effect clamping of the clamping jaws 5 and 6 on the contact rail 2 and/or a bus bar 7, the latter passing by a row of such clamps and being indicated in FIG. 1 in broken lines. The bus bar 7 supplies the contact rail 2 with power when the connection therebetween via the slide 4 is completed as seen in FIG. 1.

Figure 2:
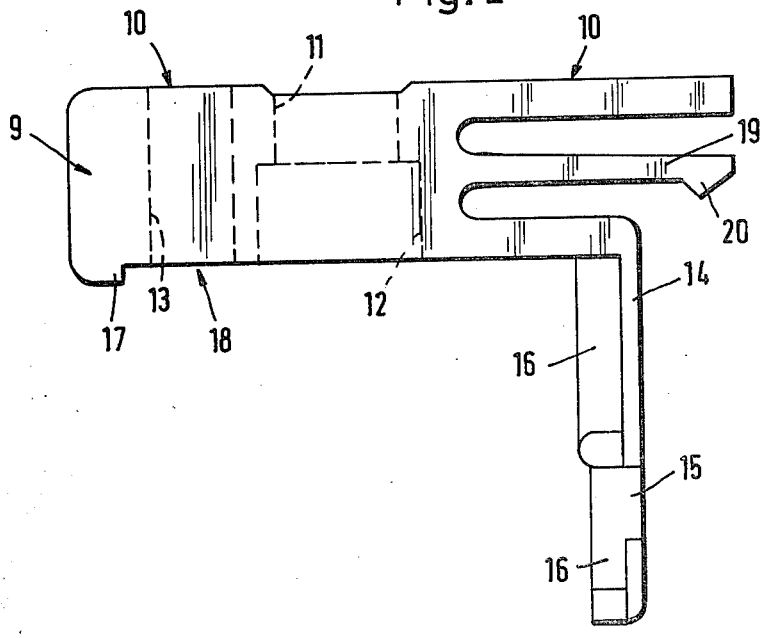
FIG. 2 is an enlarged side elevational view of the guide of FIG. 1.
Figure 3:
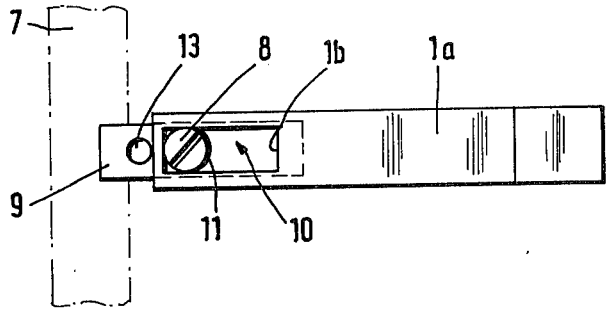
FIG. 3 is a top plan view of the clamp of FIG. 1.

In order to be able to shift the slide 4, which is relatively free to move when the clamping jaws 5, 6 are loose, without problems towards and into contact with the bus bar 7, i.e., to the position in which the slide is shown in FIG. 1, or in order to be able to shift the slide back into the housing easily and without the danger of tilting motions when it is desired to break the connection between bus bar 7 and contact rail 2, a guide 9 (FIGS. 1 and 2) is disposed between the clamping jaw 5 of the slide 4 and the housing 1. The guide 9 is shown in FIG. 1 as a one-piece plastic construction, having an elongated surface 10 on its top side which is slidably engageable with an inner surface 22 of a wall 1*a* of the housing 1. The guide 9 has an access opening or passage 11 which leads to a receiving chamber 12, in which the screw head of the clamping screw 8 is located. Thus the portion of the guide which surrounds the opening or passage 11 and through which, with assistance from the screwdriver used to turn the screw, the force to shift the slide 4 is transmitted, borders directly on the elongated surface 10. The wall 1*a* is provided with an elongated opening 1*b* such that the screw 8 can be accessed with the screwdriver, irrespective of to which position the slide 4 is shifted.

The guide 9 is further provided with an opening 13 for a testing plug.

The guide 9 has a bent portion or leg 14, which engages projecting portions 25 and 26 on both sides of the clamping jaws 5 and 6, respectively, of the slide 4. The leg 4 includes an opening 15 for the passage of the contact rail 2. Engagement of the leg 14 of the guide 9 with the portions 25 and 26 of the clamping jaws results in particularly good force transmission when it is desired to shift the slide 4 from a neutral position within the housing (not shown) to an engaged position where an electrical connection between bus bar 7 and contact rail 2 is established (as seen in FIG. 1).

The leg 14 is provided with a flange or projection 16 which extends along and in contact with the portions 25 and 26 of clamping jaws 5 and 6 in such a way that the clamping jaws 5 and 6 cannot rotate relative to one another when the clamping screw is tightened, as it can happen particularly when the clamping jaws 5 and 6 are constructed as hollow jaws.

The guide 9 can be mounted to a surface 24 on the top side of the upper clamping jaw 5. For this purpose, a receiving means 18 is provided on the bottom side of the guide, comprising a recessed surface 23 bounded by a shoulder 17 and the leg 14. The leg 14 possesses, due to the use of plastic material, a limited amount of resilience so that it can flex when the guide is mounted on the upper clamping jaw 5. The receiving means 18 further assists in transmission of shifting force to the slide 4. This is particularly true when it is desired to shift the slide 4 from the engaged position shown in FIG. 1 to a neutral position whthin the housing out of contact with the bus bar 7. Force applied to the guide 9 is transmitted to the upper clamping jaw 5 by means of the engagement of shoulder 17 of the guide and a surface 27 on the front side of the upper clamping jaw.

The guide 9 has a projection or detent 20 which allows for a releasable locking of the slide 4 in its neutral position, i.e., in a position where it is withdrawn into the housing of the clamp, spaced from the bus bar 7. The detent 20 is mounted onto the end portion of a leg 19 of the guide 9. On the housing 1 of the clamp another projection or detent 21 is provided. The releasable locking of the clamp on a neutral position is particularly important when the clamp is mounted perpendicularly above. Or approximately perpendicular above, the bus bar. The slide 4 cannot thus accidentally fall out of the neutral position onto the bus bar, which carries the power supply, not even if the clamping screw 8 was not properly tightened when the slide was shifted to the neutral position.

It is within the purview of the invention that various modifications can be made to the clamp including the housing 1, slide 4 and guide 9. For example, a fastener other than screw 8 could be employed which could be accessed with an appropriate tool through the access opening 11. As another example, the releasable engagement means shown in FIG. 1 as mating detents 20 and 21 could be a detent and a matching indent.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A clamp for establishing electrical connection between first and second spaced-apart conductors, comprising a housing mounted on a portion of said first conductor and having a first surface facing said first conductor; slide means mounted on said first conductor for movement in predetermined directions into and out of clamping contact with said second conductor and having a second surface facing away from said first conductor and towards said first surface; and guide means disposed between said first and second surfaces and having first receiving means on one side of said guide means for mounting said guide means on said second surface and an elongated surface on an opposite side of said guide means for slidably engaging said first surface of said housing to thereby preclude rotation of said slide means relative to said first conductor.

2. The clamp of claim 1, wherein said slide means comprises first and second clamping jaws flanking said first conductor and fastener means interconnecting said clamping jaws; said first clamping jaw having said second surface; said guide means further including a passage therethrough for accessing said fastener means.

3. The clamp of claim 2, wherein said guide means further comprises means for engaging said clamping jaws for transmission of force applied to said guide means to said clamping jaws and for further prevention of relative rotation.

4. The clamp of claim 3, wherein said clamping jaws have first and second projecting portions, respectively, and said engaging means comprises a leg extending along side and in contact with said projecting portions.

5. The clamp of claim 4, wherein said leg includes second receiving means for said first and second projecting portions so as to restrict relative rotational movement of said clamping jaws.

6. The clamp of claim 5, wherein said second receiving means comprises a flange on said leg.

7. The clamp of claim 4, wherein said leg includes a passage through which said first conductor extends.

8. The clamp of claim 4, wherein said first clamping jaw further includes a third surface on a side opposite said first projecting portion; said engaging means further comprises a shoulder extending along side and in contact with said third surface; and said first receiving means comprises a recessed surface bounded by said leg and said shoulder.

9. The clamp of claim 1, wherein said guide means includes an opening for access to said slide means with a testing device.

10. The clamp of claim 1, wherein said guide means further comprises means for releasably locking said guide means against movement in said housing.

11. The clamp of claim 10, wherein said releasable locking means comprises first detent means mounted on said guide means and second detent means mounted on said housing.

12. The clamp of claim 11, wherein said guide means further comprises a resilient strip and said first detent means comprises a projection mounted on the end of said strip.

13. The clamp of claim 2, wherein said housing is composed of insulating material and further comprises an elongated opening in said first surface for accessing said passage in said guide means.

14. A clamp for establishing electrical connection between first and second spaced-apart conductors, comprising a housing mounted on a portion of said first conductor; slide means mounted on said first conductor for movement in predetermined directions into and out of contact with said second conductor, said slide means comprising first and second clamping jaws flanking said first conductor and fastener means interconnecting said clamping jaws; and guide means mounted between said housing and one of said clamping jaws, said guide means comprising a one-piece plastic construction having an elongated first surface for slidable engagement with said housing, a first leg extending along side and in contact with said clamping jaws for restricting movement of said clamping jaws and transmitting shifting force to said clamping jaws, a shoulder extending along side and in contact with another side of one of said clamping jaws opposite to the side contacted by said first leg for transmitting shifting force to said clamping jaws, a recessed surface defined by said first leg and said shoulder for securely mounting said guide means on said one of said clamping jaws, said first leg including a passage through which said first conductor extends and a flange which extends from said first leg and engages said clamping jaws to thereby preclude relative rotation of said clamping jaws, and a second leg including releasable locking engagement means for positively retaining said slide means at a desired location within the housing out of contact with said second conductor.

* * * * *